US006205720B1

(12) United States Patent
Wolfrum

(10) Patent No.: US 6,205,720 B1
(45) Date of Patent: Mar. 27, 2001

(54) FOUNDATION PANEL AND METHOD OF ASSEMBLY

(76) Inventor: Daryl R. Wolfrum, 607 Pioneer Rd., Grand Junction, CO (US) 81504

( * ) Notice: Subject to any disclaimer, the term of this patent is extended or adjusted under 35 U.S.C. 154(b) by 0 days.

(21) Appl. No.: 09/221,273

(22) Filed: Dec. 23, 1998

Related U.S. Application Data

(60) Provisional application No. 60/068,870, filed on Dec. 24, 1997.

(51) Int. Cl.[7] ..... B60R 9/02

(52) U.S. Cl. ..... 52/169.12; 52/169.5; 52/169.9; 52/299; 52/741.3; 52/DIG. 3

(58) Field of Search ..... 52/169.5, 169.6, 52/169.9, 169.11, 169.12, 169.14, 299, 506.01, 631, 741.3, 745.06, DIG. 3, 302.1, 656.1

(56) References Cited

U.S. PATENT DOCUMENTS

| | | | | |
|---|---|---|---|---|
| 1,495,406 | * | 5/1924 | Deyo | 52/302.1 |
| 2,104,876 | | 1/1938 | Wetherbee . | |
| 2,294,890 | * | 9/1942 | Brinker | 52/220.4 |
| 3,388,514 | | 6/1968 | Archinal et al. . | |
| 3,397,494 | | 8/1968 | Waring . | |
| 3,753,323 | * | 8/1973 | Nesbitt | 52/169.12 |
| 3,798,853 | * | 3/1974 | Castle | 52/299 X |
| 3,832,813 | * | 9/1974 | Hindman | 52/DIG. 3 X |
| 4,075,810 | * | 2/1978 | Zakrzewski et al. | 52/169.5 X |
| 4,263,762 | | 4/1981 | Reed . | |
| 4,373,304 | | 2/1983 | Howitt . | |
| 4,464,873 | | 8/1984 | Geiger . | |
| 4,680,904 | | 7/1987 | Stoecker . | |
| 4,738,061 | * | 4/1997 | Herndon | 52/DIG. 3 X |
| 4,843,793 | * | 7/1989 | Ayers | 52/DIG. 3 X |
| 4,856,240 | * | 8/1989 | McHale | 52/169.14 |
| 5,448,861 | * | 9/1995 | Lawson | 52/741.3 X |
| 5,535,556 | | 7/1996 | Hughes, Jr. . | |
| 5,617,693 | * | 4/1997 | Hefner | 52/693 |
| 5,690,305 | * | 11/1997 | Perkins | 52/DIG. 3 X |
| 5,937,607 | * | 8/1999 | Li | 52/656.1 |

* cited by examiner

*Primary Examiner*—Carl D. Friedman
*Assistant Examiner*—Phi Dieu Tran
(74) *Attorney, Agent, or Firm*—Brian D. Smith, P.C.

(57) ABSTRACT

A prefabricated foundation panel for being supported on a footing to support the perimeter floor sill of a mobile home is disclosed. The panel has a generally rectangularly shaped frame including generally elongate, parallel and spaced, metallic top and bottom members as well as a plurality of spaced metallic cross members which are rigidly affixed to the top and bottom members. The outermost cross members of the frame are positioned so that they are flush with the ends of the top and bottom members. The top, bottom and cross members collectively define a plurality of spaces extending through the frame from an outer side thereof to an inner side thereof. A decorative aggregate coated facing is also provided for the panel which is attached to the outer side of the frame and which covers the plurality of spaces. A method of installing the panels around the lower periphery of a mobile home to enclose the lower periphery is also disclosed.

21 Claims, 2 Drawing Sheets

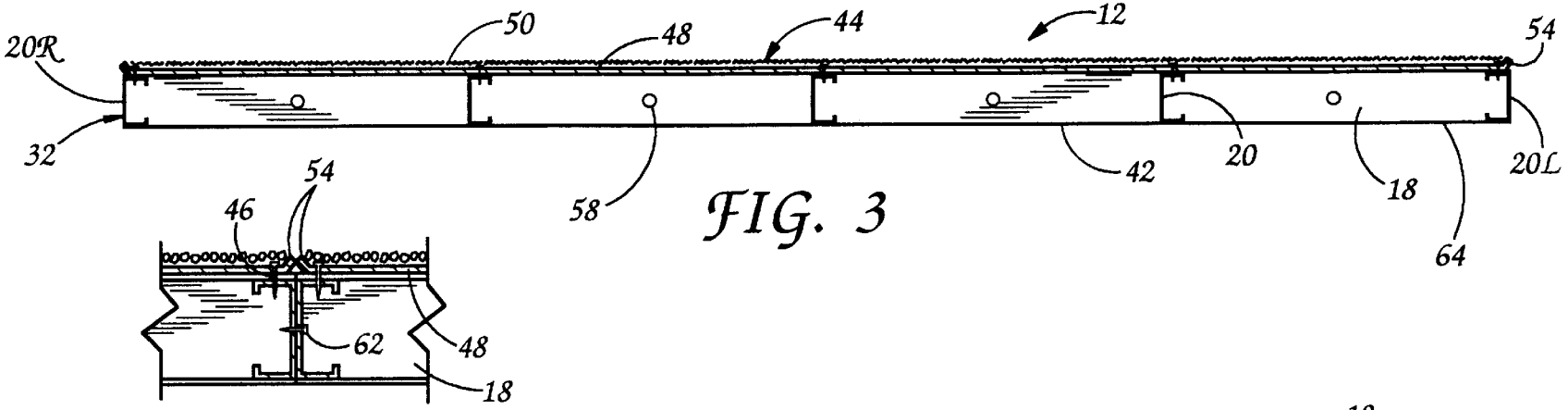
FIG. 3
FIG. 3A
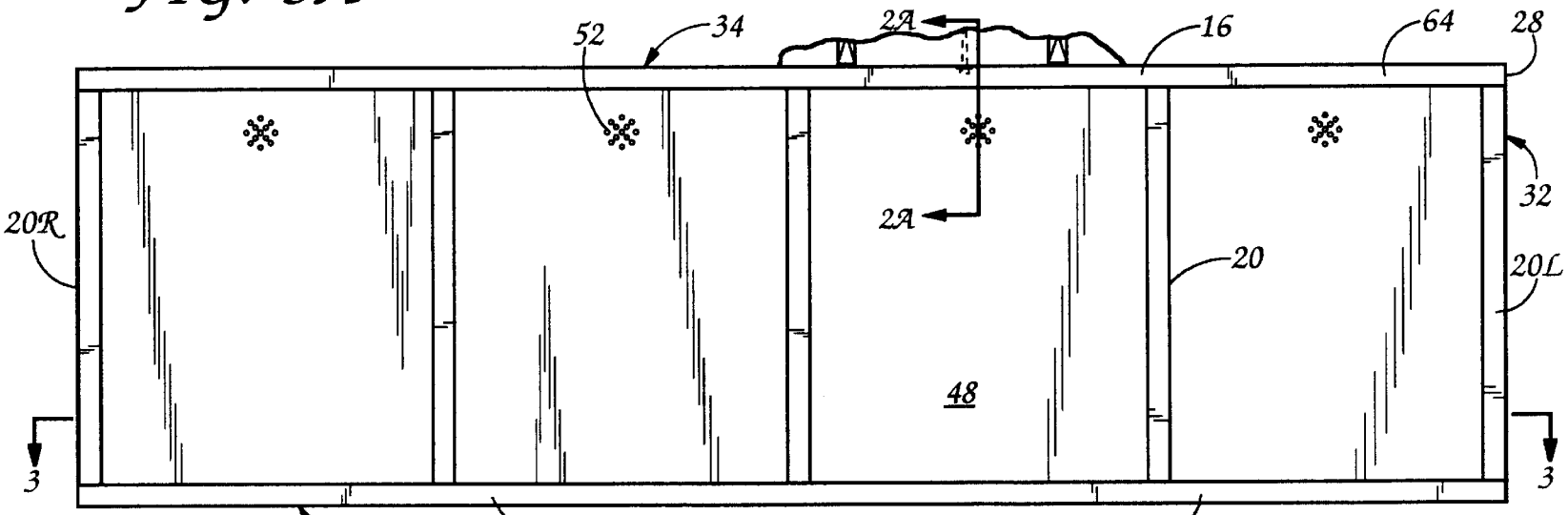
FIG. 4

FOUNDATION PANEL AND METHOD OF ASSEMBLY

CROSS REFERENCE TO RELATED APPLICATIONS

This application is a nonprovisional application claiming the benefit under 35 USC 119(e) of U.S. provisional application Ser. No. 60/068,870, filed on Dec. 24, 1997.

TECHNICAL FIELD OF THE INVENTION

The invention relates generally to building foundations and more particularly to a foundation skirting for mobile homes and the like.

BACKGROUND OF THE INVENTION

Skirting systems have been used for many years around mobile homes or trailer houses for the purpose of insulating the trailer from outside temperature changes and also for improving the appearance of the mobile home or trailer house. Representative of the art is that shown in U.S. Pat. No. 4,680,904 to Stoecker which discloses a portable skirting system. While this system is undoubtedly quite portable, it provides little or no support for the outer walls of the mobile home. Such support along the perimeter of a mobile home is needed for many of today's newer mobile homes due to the increasing size of today's mobile homes as well as the increasing use of heavy dry wall on the home's exterior walls. Unless supported, the exterior walls of many of these homes using dry wall will sag and possibly even buckle.

DISCLOSURE OF THE INVENTION

It is an object of the invention to provide a prefabricated foundation panel and foundation assembly for mobile homes and the like which is easily installed about the lower periphery of a mobile home and easily uninstalled if the owner is desirous of moving the home.

It is another object of the invention to provide such a prefabricated foundation panel and foundation assembly which is capable of supporting a load of up to 1000 pounds or more per linear foot.

It is a yet further object of the invention to provide such a prefabricated foundation panel and foundation assembly for mobile homes and the like which is aesthetic and which is strong enough to permit backfilling of soil against it.

It is yet another object of the invention to provide such a prefabricated foundation panel and foundation assembly which is weather resistant and capable of being easily insulated.

The present invention addresses these problems by providing a prefabricated foundation panel for being supported on a footing to support the perimeter floor sill of a mobile home and the like. The panel has a generally rectangularly shaped frame including generally elongate, parallel and spaced, metallic top and bottom members as well as a plurality of spaced metallic cross members which are rigidly affixed to the top and bottom members preferably by welding. In addition, the outermost cross members of the frame are positioned so that they are flush with the ends of the top and bottom members. The top, bottom and cross members collectively define a plurality of spaces extending through the frame from a first side thereof to a second side thereof. A facing is also provided for the panel which is attached to the first side of the frame and which covers the plurality of spaces.

In a preferred embodiment of the invention, the facing has a coating of aggregate adhered to it for decorative purposes as well as a plurality of uniquely camouflaged vent holes. The vent holes are defined by the open ends of cylindrical projections which extend outwardly from and through the facing. The distance which the projections extend, i.e. their height, is slightly less than the thickness of the aggregate coating. As such, the aggregate serves to hide or camouflage the vent holes.

As mentioned, the panels are prefabricated and are easily installed around the lower periphery of a mobile home by simply fastening the top member to the underside surface of the mobile home's floor sill and the bottom member to the concrete footing which preferably extends around the perimeter of the home. Adjacent panels are easily installed by simply abutting an end of the adjacent panel (which is defined by an outermost cross member of the panel) flush up against that of the first panel installed. The flush abutting ends, i.e. the flush abutting outermost cross members of the adjacent panels, are then affixed to each other, preferably with self drilling screws. The top and bottom members of the adjacent panel are then fastened to the floor sill and footing, as previously described. Additional panels are then similarly installed until the entire perimeter of the mobile home is enclosed.

Other objects, advantages, and novel features of the present invention will become apparent from the following detailed description of the invention when considered in conjunction with the accompanying drawings.

BRIEF DESCRIPTION OF THE DRAWINGS

FIG. 3 is a cross sectional view taken along lines 3—3 of FIG. 4;

FIG. 3A is an enlarged partial cross sectional view similar to that of FIG. 3 which additionally shows the attachment of the panel at one of its ends to an adjacent panel; and FIG. 4 is a rear elevational view of the panel of FIGS. 1–3.

BEST MODE FOR CARRYING OUT THE INVENTION

Figure 1:
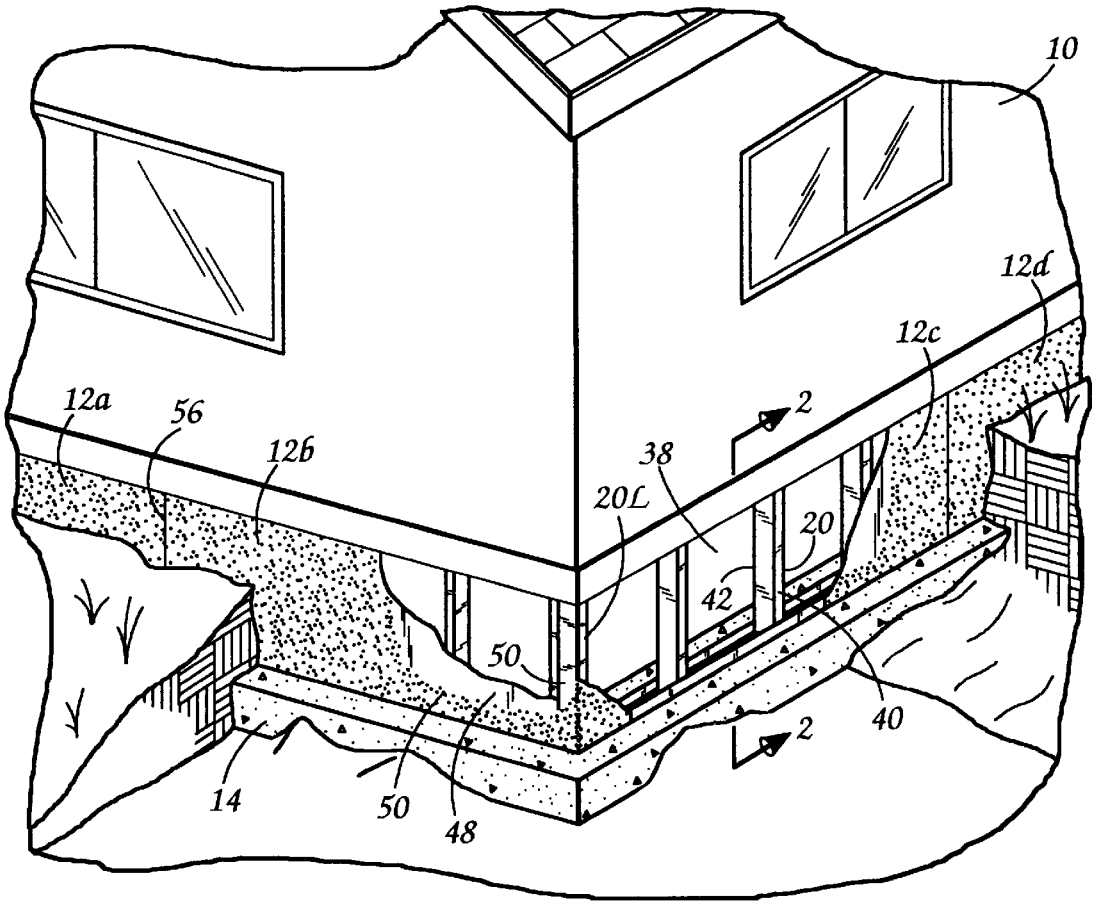
FIG. 1 is a perspective view of a mobile home having the present invention installed thereon, with portions of the skirting soil broken away for clarity.

Referring now to the drawings, wherein like reference numerals designate identical or corresponding parts throughout the several views, FIG. 1 shows a mobile home 10 having a plurality of prefabricated foundation panels 12 of the present invention installed around its lower periphery.

Figure 2:
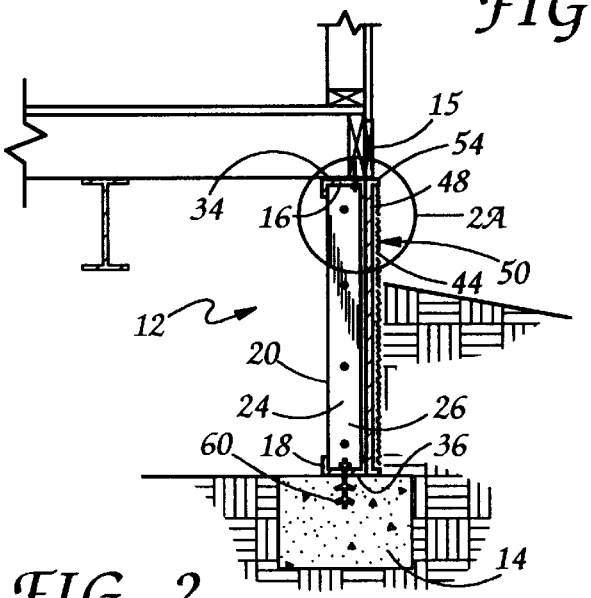
FIG. 2 is a cross sectional view taken along line 2—2 of FIG. 1.

FIGS. 1 and 2 show that each panel 12 is supported on a continuous concrete footing 14 which extends around the entire periphery or perimeter of the home. It can also be that each panel in turn supports the perimeter floor sill 15 of the mobile home and while not shown each is also secured to the floor sill as described in more detail below.

As also shown, each panel 12 has a generally rectangularly shaped frame (not numbered) which consists of a pair of parallel spaced metallic top and bottom members 16 and 18 as well as a plurality of spaced metallic cross members 20 which are rigidly affixed to top and bottom members 16, 18, preferably by welding. Welds 22 for joining a cross member 20 to the top member 16 are shown in FIG. 2A.

FIG. 2 further shows that top and bottom members 16, 18 are U-shaped tracks and that they are positioned with respect to each other so that their open U-shaped sides face each other. FIG. 3 shows that each cross members is a C-shaped metallic stud and FIGS. 1 through 2A illustrate that the upper and lower ends 24, 26 of the cross members are received in the U-shaped portions of the top and bottom track members and rigidly affixed thereto by the previously described welds 22.

FIGS. 3 and 4 further illustrates that the outermost C-shaped cross members located on the ends of a panel which are identified by the numerals 20L and 20R are flush with the ends 28 of the top and bottom members 16, 18 and are positioned so that their open C-shaped sides 30 face each other. Thus, it will be appreciated that the other side 32 of cross members 20L, 20R which is flat provides the ends of each panel with a flat or planar surface 32. Surface 32 and side 32 of the cross member 20L and 20R are identified with the same number since they refer to the same surface.

Figure 2A:
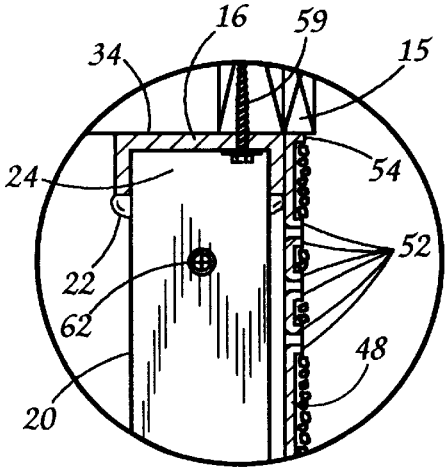
FIG. 2A is an enlarged partial cross sectional view of the circled area of FIG. 2 which is also taken along lines 2A—2A of FIG. 4.

It will also be appreciated and is shown in the drawings that top and bottom surfaces 34, 36 of each panel are also flat or planar surfaces since these surfaces are respectively defined by the flat outer facing surfaces of the top and bottom U-shaped track members which is flat as perhaps best shown in FIG. 2A. Thus, it will be appreciated that flat top and bottom surfaces 34, 36 are flush with flat surfaces 32 of the outermost cross members 20L and 20R and thereby provide the panel with a flat edge (not numbered) which extends around the entire periphery of the panel.

The spacing between the top, bottom and cross members 16, 18 and 20 (and therefore defined thereby) are identified as open spaces 38. As best shown in FIG. 3, open spaces 38 extend through the frame from a first or outer side 40 thereof to a second or inner side 42 thereof. As also shown, these spaces are covered on the outer side 40 of the frame by a facing 44 which is rigidly affixed to the frame with pop rivets 46 as shown in FIG. 3.

Facing 44 includes a sheet 48 of metal and a coating of stone aggregate 50 which is applied to sheet 48 with an adhesive such as a rubberized epoxy. A adhesive which has been found to provide good adhesion is sold under the trademark Chemcaulk by Bostik, Inc. of Middleton, Mass. A stucco like product may also be applied to sheet 48 instead of aggregate 50 Indeed, sheet 48 in accordance with the present invention may have any type of decorative coating applied to it or none at all. For example, it may be desirable to dispense with a coating all together and simply stamp a design on sheet 48.

If, however, the panel is to be provided with a decorative coating of stone aggregate, the present invention provides a unique way of incorporating vent holes into the panel which can be camouflaged by the aggregate. The vent holes are provided by punching the sheet with cylindrically shaped punches which form cylindrical projections 52 in the sheet as shown in FIG. 2A. Projections 52 have a height above the surface of sheet 48, i.e. they extend outwardly from and through sheet 48 a distance which is slightly less than the thickness of the aggregate coating. As such, the aggregate serves to hide or camouflage the vent holes. FIG. 4 shows that a plurality of vent hole projections 52 are provided in the panel, the number of which is determined by local housing codes regarding ventilation While not easily seen in the figures, a close inspection of FIGS. 2A, 3 and 3A will reveal that sheet 48 is provided with a lip 54 that extends about its entire periphery. The lip serves to contain the adhesive and the stone aggregate when it is applied to the sheet. As shown in FIG. 2A, the lip is provided with a 90 degree turn when it extends along the top and bottom members 16, 18 of the panel. However, as shown in FIGS. 3 and 3A when extending along the panel's ends along surfaces 32 the lip is provided with only a 45 degree turn. The 45 degree lip abuts up against the opposing 45 degree lip of an adjacent panel as shown in FIG. 3A to insure that the joint between adjacent panels is covered and is as unnoticeable as possible. No more should be seen than the joint line 56 of FIG. 1.

The prefabricated panels are easily installed around the perimeter of a mobile home by simply fastening the panel's top member 16 to the underside surface of the mobile home's floor sill with a fastener such as a lag bolt (not shown) which are inserted through holes 58 provided in top member 16 and then screwed into the home's floor sill. The bottom member 18 which is also provided with holes 58 is then fastened to the concrete footing 14 with fasteners such as a wedge anchor 60 as such is shown in FIG. 2. Adjacent panels are easily installed by simply positioning an end of the adjacent panel (which is defined by an outermost cross member of the panel as shown in FIG. 3A) flush up against that of the first panel installed. The flush abutting ends, i.e. the flush abutting outermost cross members of the adjacent panels, are then affixed to each other with fasteners, preferably with self drilling screws 62. The top and bottom members of the adjacent panel are then fastened to the floor sill and footing, as previously described. Additional panels are then similarly installed until the entire lower periphery of the mobile home is enclosed.

Corners of the mobile home are enclosed with either a right or a left corner panel such as left corner panel 12*c* illustrated in FIG. 1. Left corner panel 12*c* is identical to the standard panel 12 described above with the exception that the panel's left end (defined by the flat surface 32 of the left cross member 20L) is provided with a facing similar to facing 44 having a sheet of metal similar to sheet 48 with a lip similar to lip 54. A coating of aggregate 50 is also applied to the sheet as shown. An adjacent panel such as panel 12*b* shown in FIG. 1 is then installed at the corner in the same manner as described above except that instead of surfaces 32 abutting each other, surface 32 of the adjacent panel 12*b* abuts up against a back edge 64 of the top and bottom track members 16, 18 as shown in FIGS. 3 and 4. Fasteners 62 are then used to fasten these surfaces together.

From the foregoing, it will be appreciated that the preferred embodiment disclosed herein does indeed accomplish the aforementioned objects. For example, in addition to being easily installed it will be appreciated that the panels can be easily uninstalled or removed if the owner is desirous of moving the mobile home to which they are attached. The panel are also very easily insulated if such is desired by simply installing insulation in the spaces 38 of the panel. In addition, a structural engineer will appreciate that foundation assembly will be able to easily support a load of up to 1000 pounds per linear foot and is clearly strong enough to permit backfilling of soil against it.

While the invention has been particularly shown and described with reference to a preferred embodiment thereof, it will be understood by those skilled in the art that changes in form and details may be made therein without departing from the spirit and scope of the invention.

I claim:

1. A prefabricated foundation panel for being supported on a footing to support a perimeter floor sill of a mobile home, said panel comprising:

a generally rectangularly shaped frame including generally elongate, parallel and spaced top and bottom members and a plurality of spaced cross members rigidly affixed to said top and bottom members with the outermost cross members joining said top and bottom members so that they are flush with the ends of said top and bottom members, said top, bottom and cross members collectively defining a plurality of spaces extending through said frame from a first side thereof to a second side thereof, said top, bottom and cross members also having a metallic composition; and a facing attached to said first side of said frame and covering said plurality of spaces;

wherein each said top and bottom members is a U-shaped track and wherein said U-shaped tracks are positioned so that their open U-shaped sides face each other;

wherein said plurality of cross members are C-shaped studs.

2. A prefabricated foundation panel as claimed in claim 1 wherein said outermost C-shaped studs joining said top and bottom members so that they are flush with the ends of said top and bottom members are positioned so that their open C-shaped sides face each other.

3. A prefabricated foundation panel as claimed in claim 1 wherein said C-shaped studs are rigidly affixed to said U-shaped tracks by welding.

4. A prefabricated foundation panel as claimed in claim 1 wherein said outermost cross members have a thickness enabling them to be joined to an abutting outermost cross member of an adjacent panel with a self-drilling screw.

5. A prefabricated foundation panel as claimed in claim 1 wherein said facing has a decorative coating applied to it.

6. A prefabricated foundation panel as claimed in claim 5 wherein said coating is aggregate which is applied to said facing with an adhesive.

7. A prefabricated foundation panel as claimed in claim 5 wherein said facing has lip extending about its periphery for containing said adhesive.

8. A prefabricated foundation panel as claimed in claim 1 wherein both outermost cross members have a generally planar outer facing surface for abutting up against a generally planar outer facing surface of an adjacent panel, said planar outer facing surface also extending from said first side of the frame to said second side of said frame.

9. A prefabricated foundation panel as claimed in claim 8 wherein said facing and one of said outer facing planar surfaces of said outermost cross members has a decorative coating applied to it so as to provide a panel for use at a corner.

10. A prefabricated foundation panel as claimed in claim 1 wherein said facing is provided with vent holes.

11. A prefabricated foundation panel as claimed in claim 10 wherein said vent holes are defined by the open ends of cylindrical projections extending outwardly from said facing.

12. A prefabricated foundation panel as claimed in claim 11 wherein said cylindrical projections defining said vent holes are formed from said facing by a punching operation.

13. A prefabricated foundation panel as claimed in claim 1 wherein said top and bottom members and said cross members frame have a steel composition.

14. A prefabricated foundation panel as claimed in claim 1 wherein said facing includes a sheet of steel composition.

15. A prefabricated foundation panel for being supported on a,footing to support a perimeter floor sill of a mobile home, said panel comprising:

a frame including spaced first and second elongate members and a plurality of spaced cross members rigidly affixed to said top and bottom members, said top, bottom and cross members collectively defining a plurality of spaces extending through said frame from a first side thereof to a second side thereof;

an aggregate coated facing attached to said first side of said frame and covering said plurality of spaces; and a plurality of vent holes defined by the open ends of cylindrical projections extending outwardly from said facing, said cylindrical projections also having an aggregate coating camouflaging said vent holes.

16. A prefabricated foundation panel as claimed in claim 15 wherein said cylindrical projections extend outwardly a distance which approximates the thickness of the aggregate coating on said facing.

17. A prefabricated foundation panel as claimed in claim 15 wherein said cylindrical projections extend outwardly a distance which is slightly less than the thickness of the aggregate coating on said facing so as to camouflage the vent holes and minimize the likelihood of said vent holes from being covered by the aggregate.

18. A prefabricated panel comprising:

a frame including spaced top and bottom members and a plurality of spaced cross members joining said top and bottom members with the outermost cross members joining said top and bottom members so that they are flush with the ends of said top and bottom members, said top, bottom and cross members collectively defining a plurality of spaces extending through said frame from a first side thereof to a second side thereof, said top, bottom and cross members also having a metallic composition; and an aggregate coated facing attached to said first side of said frame and covering said plurality of spaces;

wherein each said top and bottom members is a U-shaped track and wherein said U-shaped tracks are positioned so that their open U-shaped sides face each other;

wherein said plurality of cross members are C-shaped studs.

19. A foundation assembly for the perimeter of a mobile home for being supported on a footing to support the perimeter floor sill of the mobile home, said foundation assembly comprising:

a plurality of foundation panels wherein each panel includes:

a generally rectangularly shaped frame including generally elongate, parallel and spaced top and bottom members and a plurality of spaced cross members joining said top and bottom members with the outermost cross members joining said top and bottom members so that they are flush with the ends of said top and bottom members, said top, bottom and cross members collectively defining a plurality of spaces extending through said frame from a first side thereof to a second side thereof, said top, bottom and cross members also having a metallic composition; and a facing attached to said first side of said frame and covering said plurality of spaces; and wherein said plurality of foundation panels are arranged in a side by side fashion such that a said outermost cross member of a said panel is joined to a said outermost cross member of an adjacent panel; and wherein said top members of said panels are adapted to be secured to the perimeter floor sill of the mobile home; and wherein said bottom members of said panels are adapted to be secured to and supported by the perimeter footing for the perimeter floor sill of the mobile home.

20. A foundation assembly as claimed in claim 19 wherein said outermost cross member of a said panel is joined to said outermost cross member of an adjacent panel with a plurality of self-drilling screws.

21. A method of assembling a foundation assembly around the lower periphery of a mobile home having a perimeter floor sill and a perimeter footing, said method comprising the steps of:

providing a plurality of foundation panels wherein each panel includes:

a generally rectangularly shaped frame including generally elongate, parallel and spaced top and bottom members and a plurality of spaced cross members rigidly affixed to said top and bottom members with the outermost cross members joining said top and bottom members so that they are flush with the ends of said top and bottom members, said top, bottom and cross members collectively defining a plurality of spaces extending through said frame from a first side thereof to a second side thereof, said top, bottom and cross members also having a metallic composition; and a facing attached to said first side of said frame and covering said plurality of spaces; and arranging each panel around the periphery of the mobile home in an end to end manner so that each outermost cross member of a panel abuts up against an outermost cross member of an adjacent panel and is flush therewith; and fastening the abutting cross members of the adjacent panels to each other;

fastening the top members of the panels to the perimeter floor sill of the mobile home; and fastening the bottom members of the panels to the perimeter footing.

* * * * *